US011834139B1

(12) United States Patent
Williams et al.

(10) Patent No.: US 11,834,139 B1
(45) Date of Patent: Dec. 5, 2023

(54) SUBMERGED CONTAINER SYSTEM FOR STABILIZING ENVIRONMENTALLY-INDUCED MOTION OF A MARITIME STRUCTURE

(71) Applicant: Linc Research, Inc., Huntsville, AL (US)

(72) Inventors: Rebecca L. Williams, Huntsville, AL (US); Jeffrey L. Lindner, Huntsville, AL (US); Frederick S. Gant, Huntsville, AL (US); Hannah C. Kish, Macclenny, FL (US); John S. Townsend, Union Grove, AL (US)

(73) Assignee: LINC RESEARCH, INC., Huntsville, AL (US)

( * ) Notice: Subject to any disclaimer, the term of this patent is extended or adjusted under 35 U.S.C. 154(b) by 0 days.

(21) Appl. No.: 18/322,709

(22) Filed: May 24, 2023

Related U.S. Application Data

(60) Provisional application No. 63/473,713, filed on Jun. 17, 2022.

(51) Int. Cl.
*B63B 39/06* (2006.01)

(52) U.S. Cl.
CPC ..... *B63B 39/06* (2013.01); *B63B 2039/068* (2013.01)

(58) Field of Classification Search
CPC .... B63B 39/03; B63B 39/06; B63B 2039/068
See application file for complete search history.

(56) References Cited

U.S. PATENT DOCUMENTS 728,330 A * 5/1903 Temperley et al. ..... B63B 21/48 114/215
1,096,192 A * 5/1914 Pleva ..... B63B 39/06 114/127
3,568,620 A * 3/1971 Douglas ..... B63B 39/06 114/125
4,061,102 A * 12/1977 Bissett ..... B63B 39/062 416/68

* cited by examiner

*Primary Examiner* — Stephen P Avila
(74) *Attorney, Agent, or Firm* — Peter J. Van Bergen

(57) ABSTRACT

A motion stabilizing system includes at least one stabilizer coupled to a structure in a water environment. Each stabilizer includes a tension member, an open-ended container having a set of holes, and at least one one-way valve associated with the holes. For each stabilizer, the tension member has a first end and a second end with the first end coupled to a portion of the structure and the second end disposed in the water environment; the container is coupled to the tension member and is suspended in the water environment; and the one or more one-way valves are operable to seal the holes when the portion of the structure moves away from the container and unseal the holes when the portion of the structure moves towards the container.

17 Claims, 8 Drawing Sheets

SUBMERGED CONTAINER SYSTEM FOR STABILIZING ENVIRONMENTALLY-INDUCED MOTION OF A MARITIME STRUCTURE

Pursuant to 35 U.S.C. § 119, the benefit of priority from provisional application 63/473,713, with a filing date of Jun. 17, 2022, is claimed for this non-provisional application.

FIELD OF THE DISCLOSURE

This disclosure relates generally to motion stabilization of floating maritime structures, and more particularly to methods and systems for stabilizing environmentally-induced motion of a maritime structure using one or more submerged containers.

BACKGROUND

The term "maritime structure" may be used to describe any structure that floats on or is submerged in a maritime environment. For example, a floating maritime structure typically includes, but is not limited to, vessels, barges, ships, floating support platforms, floating docks, etc. Floating maritime structures (hereinafter referred to simply as floating structures) exhibit motion when external environmental forces such as wind, waves, and currents, are exerted upon them. Submerged maritime structures (hereinafter referred to simply as submerged structures) are generally susceptible to environmental forces caused by underwater currents. The external environmental forces induce floating/submerged structure motions (i.e., surge, sway, heave, roll, pitch, and yaw) that may be detrimental to the crew, payload, structure, and operations of the structure. The induced motions of the floating/submerged structure may also move the structure to unwanted positions. Because of this, many methods exist for positioning maritime structures and damping out the environmentally-induced motions of such structures.

Existing methods that provide some form of motion stabilization for floating structures include heave plates, sea anchors or drogues, and conventional ship anchors. Heave plates are large, flat plates designed to add motion damping to a floating structure and are typically tuned to the structure. Heave plates provide damping through viscous losses of the plate through the fluid. The viscous losses must be accounted for during the full cycle of motion of the heave plate thereby typically requiring the heave plate to be very large, heavy, and only useful for long periods of motion. Also, heave plates can only be used to address vertical motions, such as heave, pitch, and roll.

Sea anchors and drogues are typically some sort of parachute that is dragged behind a moving vessel near a water surface. These devices provide a damping force to resist horizontal motions (i.e., surge, sway, yaw) of the moving vessel. Typically, sea anchors and drogues are used as a positioning device to maintain a specific heading of the moving vessel relative to the waves to prevent broadsiding of the waves on the vessel and to prevent drift during high winds. These devices are used on smaller vessels and are not usually used on large floating structures.

Conventional ship anchors are made to drag, embed, and rest upon the sea floor using their shape to engage the sea floor and their massive weight to hold position. These anchors do not provide a damping or motion stabilizing force and are only used for positioning of a vessel. These devices are limited by the depth of the water at deployment and by their size. Other anchor options include fixed mooring points. However, these must be pre-existing at a desired location, are expensive, and may not be physically feasible in many deep-water applications.

SUMMARY

Accordingly, it is an object of the present disclosure to describe methods and systems for stabilizing environmentally-induced motion of a maritime structure.

Other objects and advantages of the methods and systems described herein will become more obvious hereinafter in the specification and drawings.

In accordance with methods and systems described herein, a motion stabilizing system includes at least one stabilizer adapted to be coupled to a structure floating in a water environment. Each stabilizer includes a tension member, an open-ended container having a set of holes, and at least one one-way valve associated with the holes. For each stabilizer, the tension member has a first end and a second end with the first end adapted to be coupled to a portion of the structure and the second end being disposed in the water environment. For each stabilizer, the container is coupled to the tension member and is suspended in the water environment. For each stabilizer, the one-way valves are operable to seal the holes when the portion of the structure moves away from the container and operable to unseal the holes when the portion of the structure moves towards the container.

BRIEF DESCRIPTION OF THE DRAWINGS

Other objects, features and advantages of the methods and systems described in the present disclosure will become apparent upon reference to the following description of the preferred embodiments and to the drawings, wherein corresponding reference characters indicate corresponding parts throughout the several views of the drawings and wherein.

DETAILED DESCRIPTION

Figure 1:
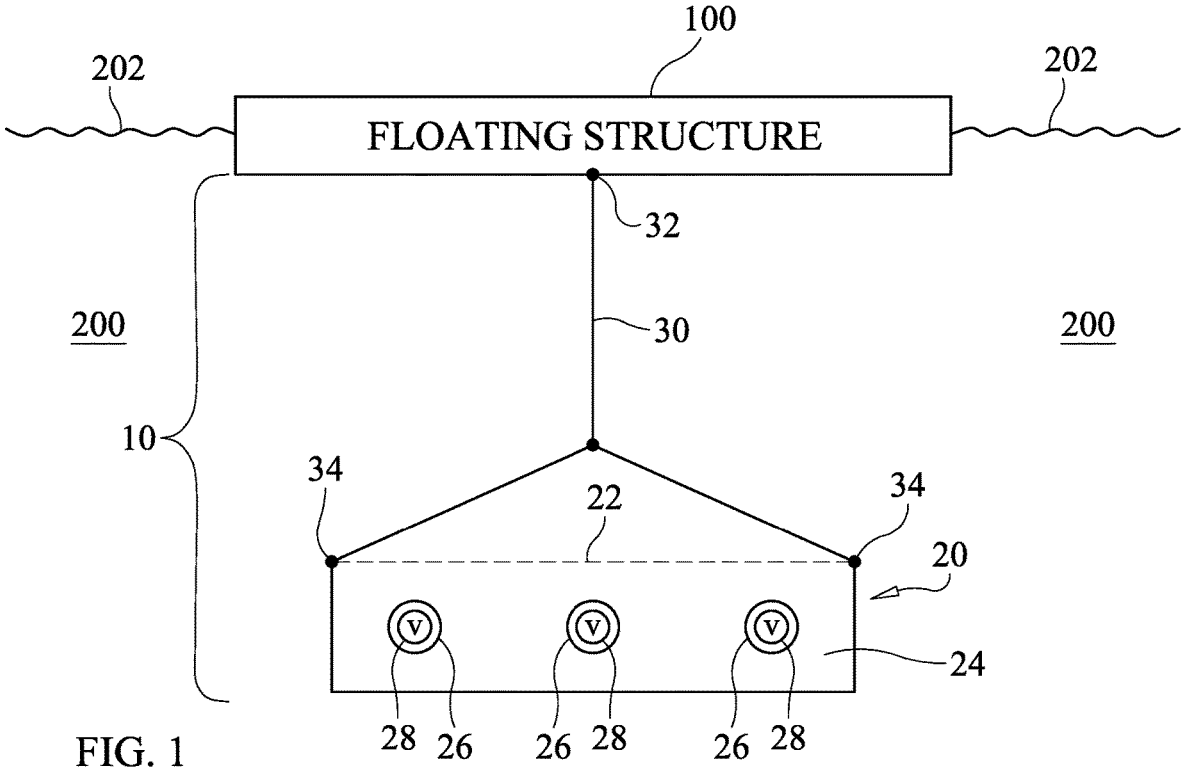
FIG. 1 illustrates a schematic view of one embodiment of a submerged container system for stabilizing environmentally-induced motion of a maritime structure in accordance with various aspects as described herein.

Referring now to the drawings and more particularly to FIG. 1, a submerged container system for use in stabilizing environmentally-induced motion of a maritime structure 100 in accordance with an embodiment of the present disclosure is shown and is referenced generally by numeral 10. As used herein, the term "maritime structure" refers to structures designed to be in a water environment to include structures designed to float at the surface of a body of water as well as structures designed to be submerged and suspended in a body of water above the floor of the body of water. By way of example and for purposes of the present disclosure, it will be assumed that maritime structure 100 is a floating structure referred to hereinafter as "floating structure 100".

Floating structure 100 may be any structure designed to float at the surface 202 of a water environment 200. In some embodiments, floating structure 100 is designed to be relatively stationary at a location on surface 202 as is the case for a wind turbine's floating support platform, floating docks, and some barge applications. In addition to remaining stationary at a location, some types of floating structures require stabilization in the face of environmentally-induced motions. As will be explained further herein, submerged container system 10 provides at-location motion stabilization for floating structure 100 experiencing environmentally-induced motion caused by one or more of waves, wind, and currents acting on the structure and/or any elements coupled to the structure.

System 10 is one or more motion stabilizers coupled to floating structure 100. In the illustrated embodiment, system 10 is a single motion stabilizer. In other embodiments and as will be described later herein, the submerged container system of the present disclosure has multiple motion stabilizers coupled to a floating structure at the water's surface. The essential features of each motion stabilizer in accordance with the present disclosure remains the same regardless of the number of motion stabilizers utilized. When multiple motion stabilizers are used, they may be configured in the same way or different ways without departing from the scope of the present disclosure.

Submerged container system 10 includes an open-ended container 20 and a tension member 30 coupled on one end 32 to floating structure 100 and on the other end(s) 34 to container 20 such that container is submerged and suspended in water 200 (i.e., not contacting the sea floor) throughout the system's operation. Container 20 has an open end (indicated by dashed line 22) such that the internal volume of container 20 fills with water 200 when submerged therein. Tension member 30 is coupled to container 20 such that open end 22 faces towards the water's surface 202, i.e., open end 22 is approximately parallel to surface 202 or is at an angle relative to surface 202 that is less than 90°. Tension member 30 may be configured to have one or more ends 34 for coupling to a corresponding number of points on container 20 without departing form the scope of the present disclosure. Tension member 30 is any elongate member (e.g., metal or composite cable, wire, chain, line, rope, etc.) that is substantially inelastic such that the deployed length of tension member 30 does not significantly change during system operations.

Container 20 includes walls 24 (e.g., side wall and, in some embodiments, bottom walls) such that an internal volume defined by walls 24 fills with water 200 when container 20 is submerged in water 200. Walls 24 have a set of holes 26 passing there through. The shape and size of holes 26 are not limitations of the systems and methods described herein. A container's holes 26 may be the same size/shape or different sizes/shapes without departing from the scope of the present disclosure.

Cooperating with each of holes 26 is a one-way valve ("V") 28 that, in operation of system 10, either seals/closes its corresponding hole 26 or unseals/opens its corresponding hole 26. In some embodiments, each hole 26 may have a dedicated valve 28 associated therewith. In some embodiments, one valve 28 may be used to control the sealing/unsealing of more than one of holes 26. In all cases, when holes 26 are sealed/closed, the internal volume of container 20 is only in fluid communication with water 200 via its open end 22. When holes 26 are unsealed/opened, the internal volume of container 20 is in fluid communication with water 200 via open end 22 and the unsealed/opened holes 26.

Figure 2:
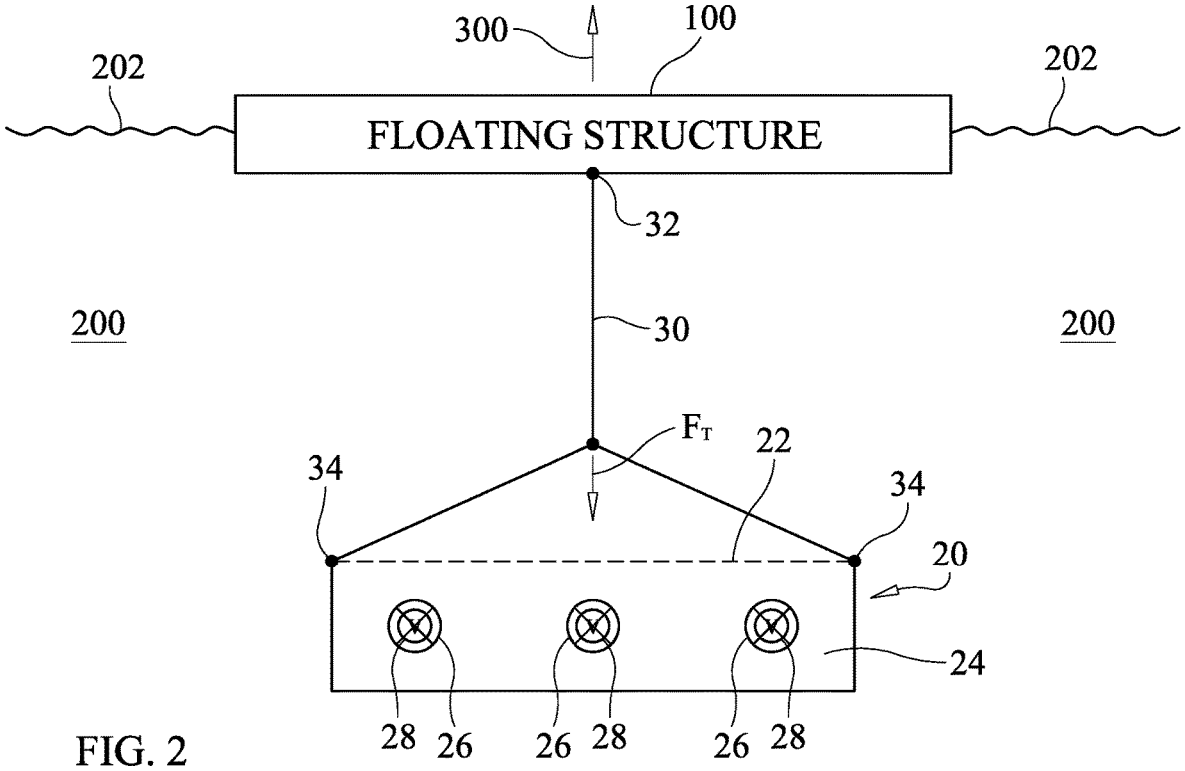
FIG. 2 illustrates the submerged container system of FIG. 1 with its valves closed to stabilize environmentally-induced motion of the maritime structure in accordance with various aspects as described herein.
Figure 3:
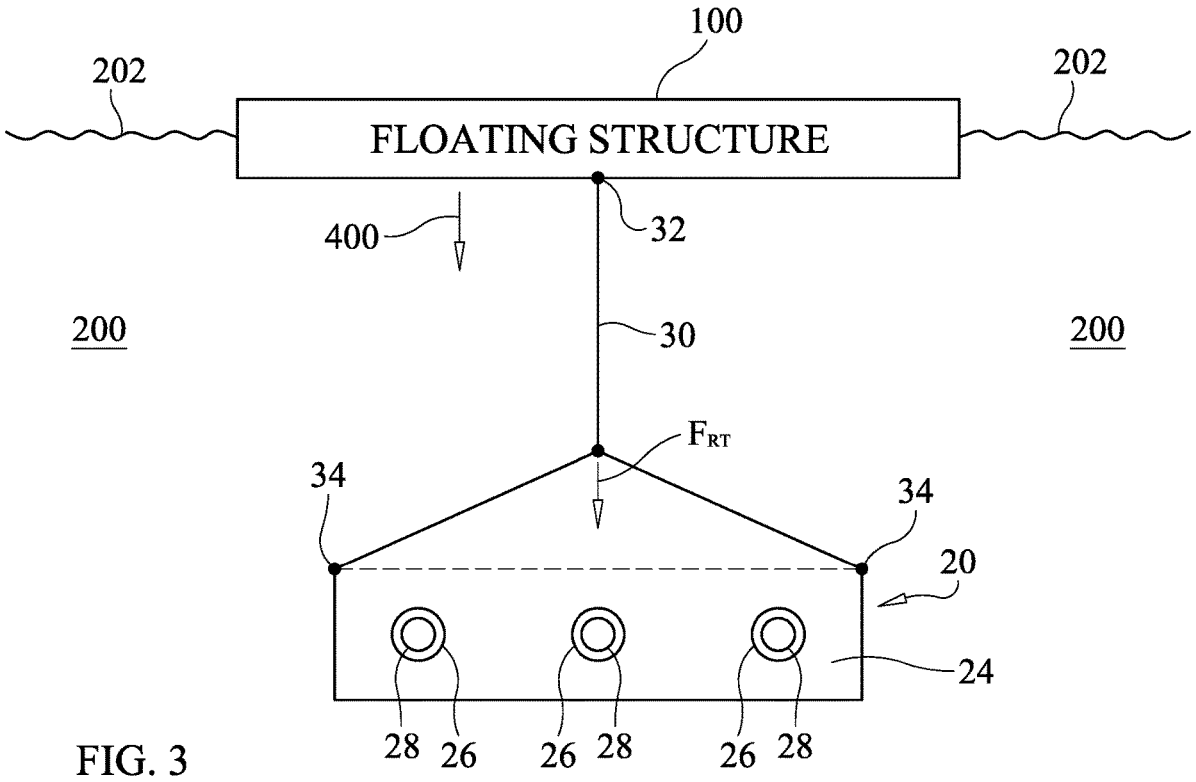
FIG. 3 illustrates the submerged container system of FIG. 1 with its valves open to maintain tension in the system's tension member in accordance with various aspects as described herein.

Referring additionally now to FIGS. 2 and 3, the operation of submerged container system 10 will be described. In FIG. 2, floating structure 100 is illustrated experiencing environmentally-induced motion that causes floating structure 100 to move up or away from container 20 as indicated by arrow 300. When this scenario occurs, valves 28 are configured to seal or close off holes 26 as indicated by the "cross" through holes 26. In FIG. 3, floating structure 100 is illustrated experiencing environmentally-induced motion that causes floating structure 100 to move down or towards container 20 as indicated by arrow 400. When this scenario occurs, valves 28 are configured to be unsealed from or open holes 26 as indicated by the "open circle" depiction of valves 28. As mentioned above, waves, wind, and/or water currents may be the cause of the environmentally-induced motion.

In the scenario illustrated in FIG. 2 with floating structure 100 moving away from container 20 and valves 28 sealing/closing holes 26, the water mass captured within container 20 applies a large resistance tension force "$F_T$" to tension member 30 that is coupled to floating structure 100 at the tension member's end 32 to effectively resist the floating structure's motion 300. More specifically, as container moves in correspondence with the structure's motion 300, the resistance tension force $F_T$ is the sum of the following:

- the hydrodynamic mass force generated by the water captured within container with its holes sealed/closed in combination with water being pushed ahead of the container's open end, the downward gravitational force due to the weight of the container, and the drag force generated by the container moving in correspondence with motion 300.

When motion 300 is halted owing to resistance tension force $F_T$, floating structure 100 experiences motion 400 back towards container 20 as illustrated in FIG. 3. That is, the sequence of motions 300 and 400 represent a typical oscillating motion of a maritime structure caused by environmentally-induced forces. As mentioned above, when floating structure 20 experiences motion 400, valves 28 are configured to open or unseal from holes 26 such that water 200 may flow through holes 26 and then open end 22 thereby allowing container 20 to sink and apply/maintain a restoring tension force "$F_{RT}$" to tension member 30 to prevent any slack from developing along tension member 30. The restoring tension force $F_{RT}$ is primarily based on the configuration of container 20 and its holes 26, and is generally much less than the resistance tension force $F_T$ generated during motion 300 of floating structure 100. The size, shape, and weight of container 20 along with the number, size, and placement of holes 26 may be selected and adjusted to provide the restoring tension force $F_{RT}$ needed to prevent slack in tension member 30.

Figure 4:
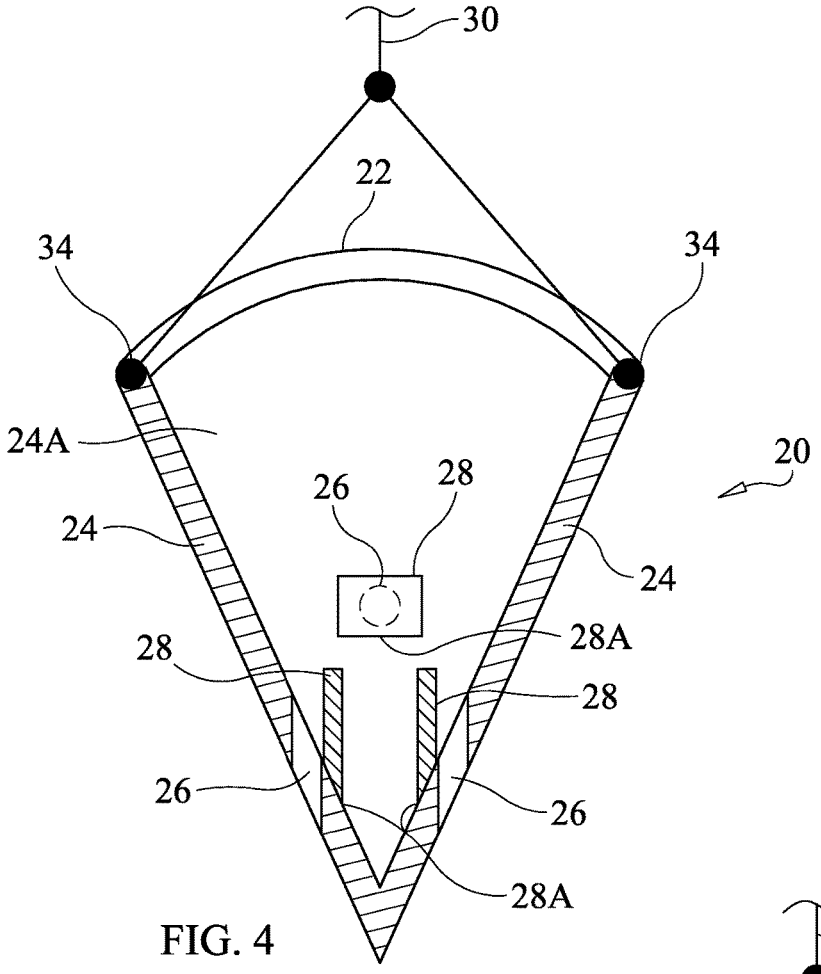
FIG. 4 illustrates an isolated cross-sectional view of one embodiment of a conical container that is to be submerged in accordance with various aspects as described herein.

Container 20 and its holes/valves 26/28 may be configured in a variety of ways without departing form the scope of the present disclosure. Several non-limiting examples of suitable containers are illustrated in FIGS. 4-7B. In FIG. 4, a cross-sectional view of a conical container 20 is illustrated. Walls 24 have holes 26 passing there through. Valves 28 may be flap or reed valves where each valve's flap or reed is fixedly attached at 28A to an inside face 24A of a wall 24 adjacent to a corresponding hole 26. More specifically, each flap or reed valve 28 is attached to a wall 24 such that it will passively close or seal its corresponding hole 26 when the floating structure moves away from container 20 thereby allowing the above-described resistance tension force $F_T$ to be generated in tension member 30, but will open or unseal (as shown) from its corresponding hole 26 when the floating structure moves towards container 20 thereby allowing the above-described restoring tension force $F_{RT}$ to be generated in tension member 30 as the container sinks in the water. In another embodiment illustrated in FIG. 5, a truncated conical container 20 having a flattened bottom wall 24 (opposing open end 22) is illustrated. Holes 26 and valves 28 (e.g., flap or reed valves as illustrated) are provided in the various walls 24.

The above-described conical and truncated conical containers may vary in radius, height, and slant angle to optimize the container for each application. For example, a flatter and wider cone will generate a larger resistive force when the floating structure moves away from the container and will move downward more slowly when the floating structure moves towards it. This type of configuration may be suitable for larger, slower moving floating structures. Extra holes/valves may be added to remove resistance to the downward motion of the container. Containers having a narrower conical shape will generate a lower resistive force as less water is captured in the container, but will move downward more quickly as the narrower conical shape presents less resistance to the container's downward motion. This type of configuration may be suitable for smaller, faster moving floating structures. Maximizing the internal volume of a container maximizes the resistance force when the floating structure moves away the container, while minimizing the cross-sectional area of the container facing the sea floor and making the container more streamlined minimizes the container's sinking resistance when the floating structure moves towards the container. A conical container may also be modified to different shapes including variation in slant angle along the height of the container. Still further, a container may have fins added to its outer edges for increased stability as it moves upward or downward through the water.

Figure 5:
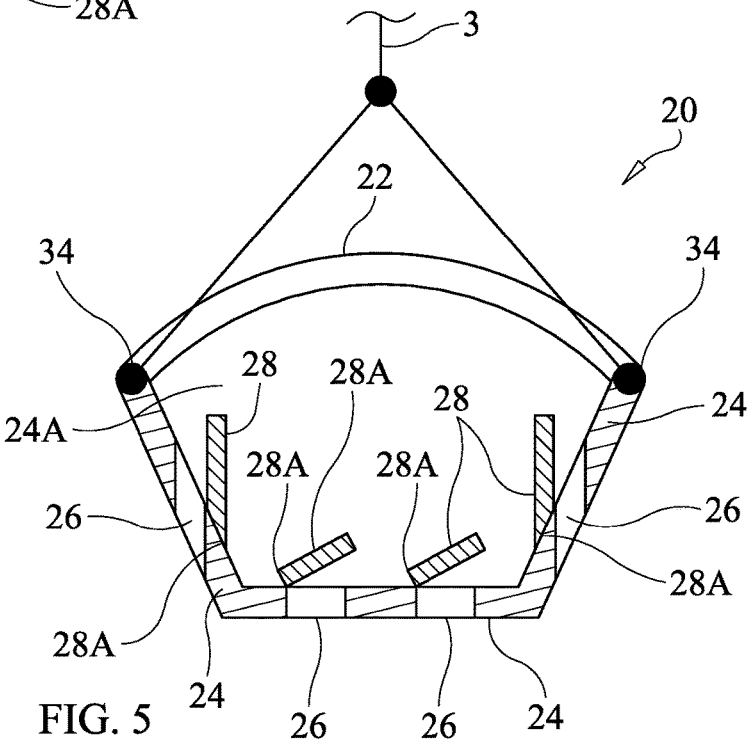
FIG. 5 illustrates an isolated cross-sectional view of an embodiment of a truncated conical container that is to be submerged in accordance with various aspects as described herein.

Containers 20 contemplated by the present disclosure include a variety of constant or fixed-shape containers as shown by way of example in FIGS. 4 and 5. However, containers of a submerged container system in accordance with the present disclosure may also be configured to be collapsible to facilitate their ability to sink through the water as well as facilitate storage, transportation, deployment, and retrieval of the system. If the container is to be used on a floating structure that is deployed at a location where it will remain permanently or semi-permanently, a fixed-shape container may be acceptable. However, on floating structures such as barges and ships that move semi-frequently and may need to park at various locations, fixed-shape containers may present various handling issues. To account for these situations, a "collapsible" container may be used. Such collapsible containers may be configured to have a compact design while in storage as well as during deployment and retrieval. Once deployed, a collapsible container will expand to its deployed shape that has a larger captured volume than its storage shape. For retrieval operations, the container can be configured to be collapsed to its storage configuration while submerged/suspended in the water in order to minimize the resistive force acting thereon as the container is raised to the water's surface.

Figure 6B:
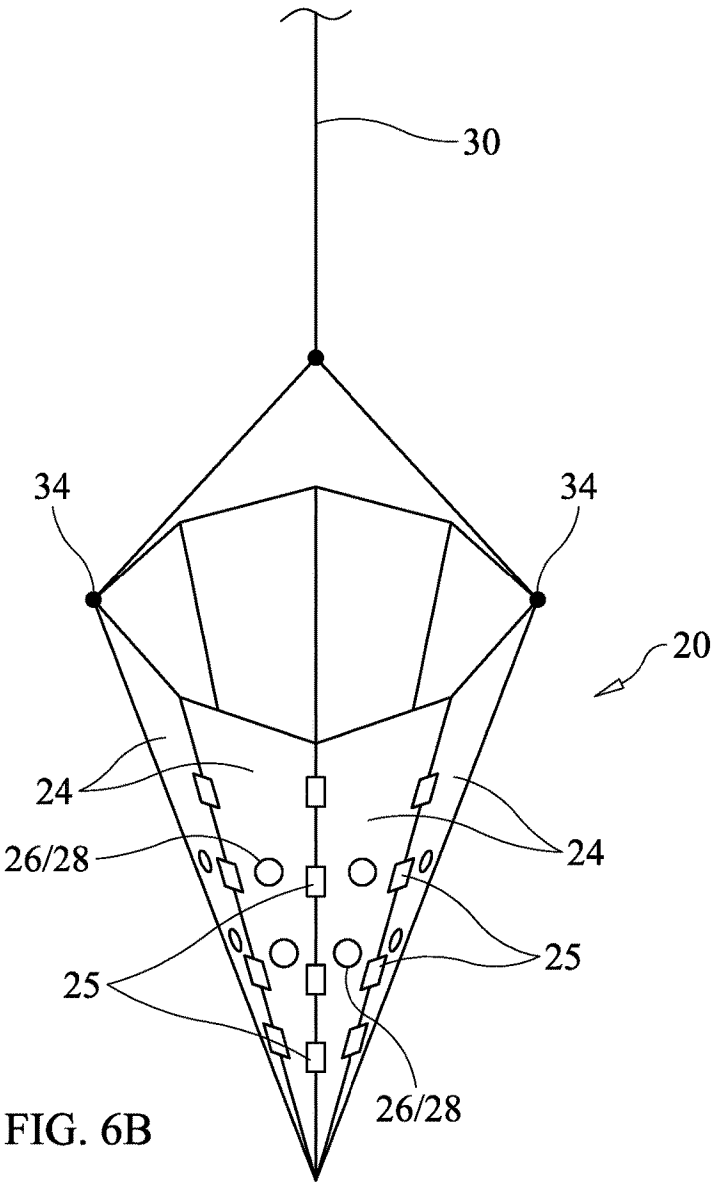
FIG. 6B illustrates an isolated perspective view of the collapsible container in FIG. 6A in its expanded state in accordance with various aspects as described herein.
Figure 6A:
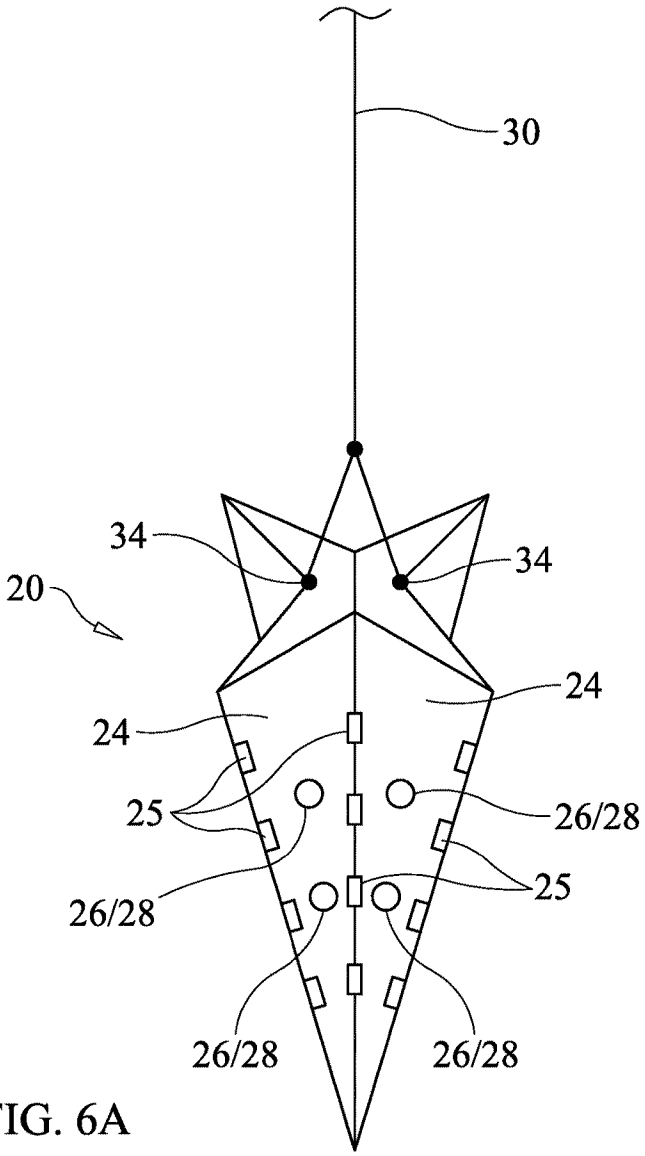
FIG. 6A illustrates an isolated perspective view of one embodiment of a collapsible container in its collapsed state in accordance with various aspects as described herein.

An embodiment of a collapsible conical container 20 for use in the presently disclosed system is illustrated in FIGS. 6A (collapsed state) and 6B (expanded state). Each wall 24 is connected to adjacent walls 24 by one or more hinges 25. Hinges 25 may be configured to alternate in terms of their permitted swing to allow walls 24 to collapse as shown in FIG. 6A and expand as shown in FIG. 6B. Hinges 25 may be configured for passive and/or active control. Holes/valves 26/28 (each combination of which is indicated by a single circle for simplicity of illustration in FIGS. 6A, 6B, 7A and 7B) are provided and function as in previous embodiments. In some embodiments, hinge control lines (not shown) may be provided to control the positions of hinges 25 and their connected walls 24 to facilitate deployment and retrieval operations. Additionally or alternatively, hinges 25 may be (spring) biased to allow container 20 to assume its collapsed state except in the presence of the above-described tension force $F_T$.

Figure 7A:
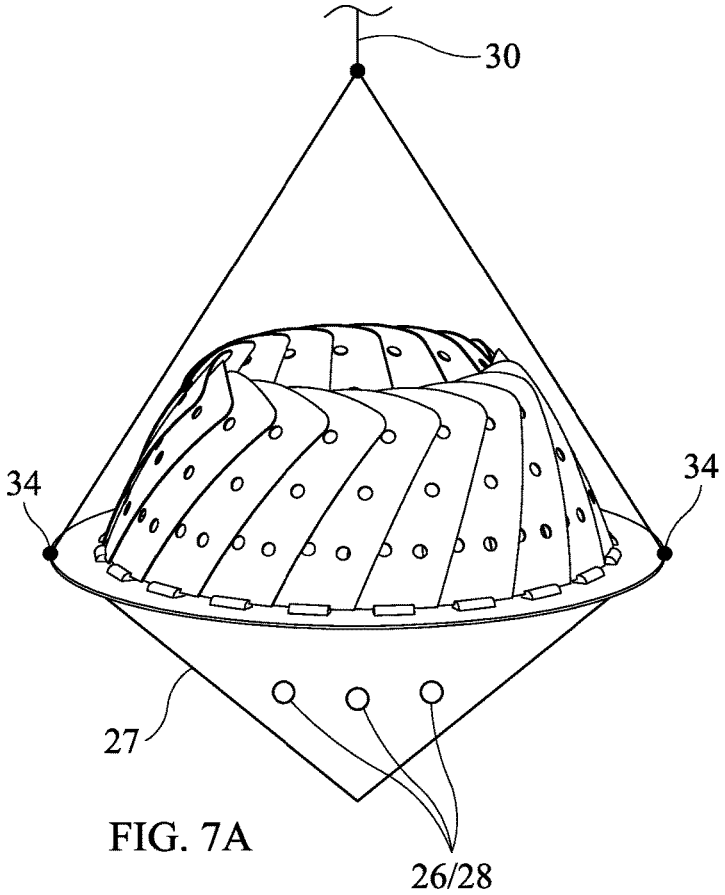
FIG. 7A illustrates an isolated perspective view of another embodiment of a collapsible container in its collapsed state in accordance with various aspects as described herein.
Figure 7B:
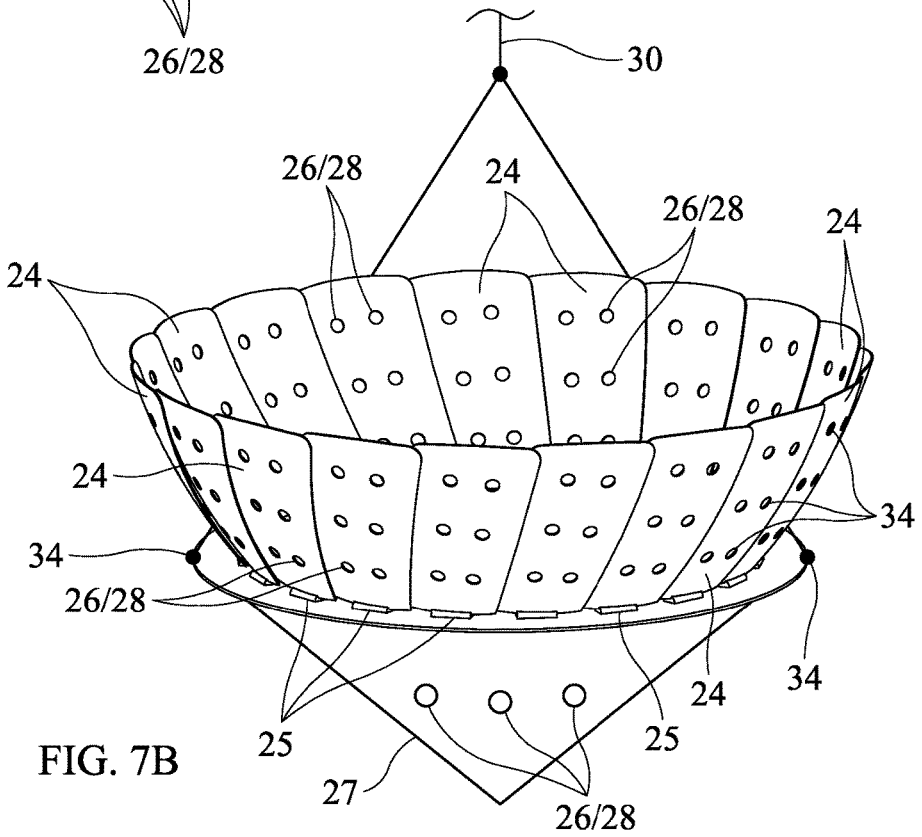
FIG. 7B illustrates an isolated perspective view of the collapsible container in FIG. 7A in its expanded state in accordance with various aspects as described herein.

In another embodiment of a collapsible container illustrated in FIGS. 7A and 7B, the container has a lower fixed-shape conical base 27 having holes/valves 26/28. Collapsible walls 24 are coupled to the open end of base 27 by hinges 25 such that walls 24 may pivot or collapse towards the central axis of base 27 (FIG. 7A) or away from the central axis of base 27 (FIG. 7B). Hinges 25 may be configured for passive and/or active control. Each of walls 24 may have the above described holes/valves 26/28.

Figure 8:
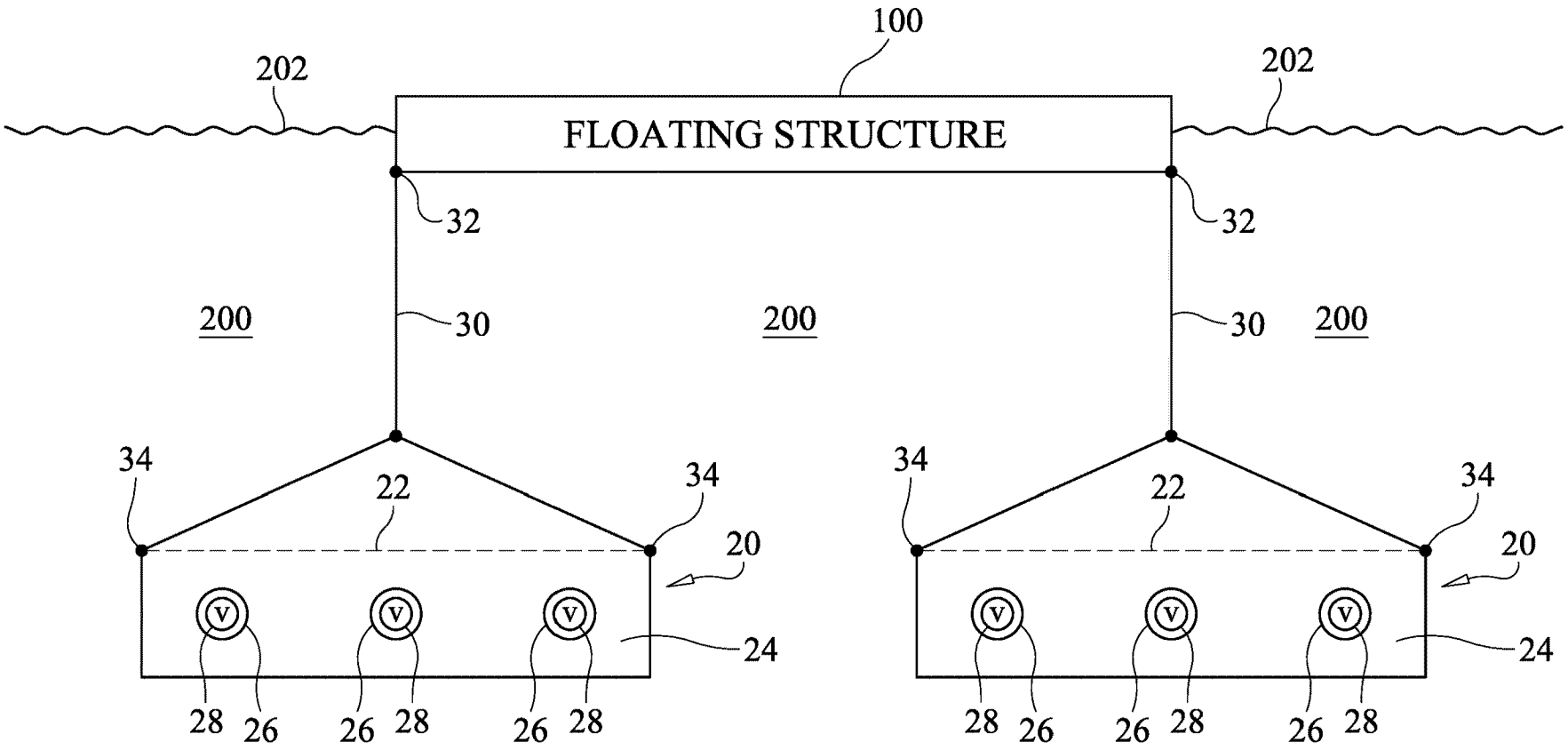
FIG. 8 illustrates a schematic view of an embodiment of a submerged container system using a set of stabilizers for stabilizing environmentally-induced motion of a maritime structure in accordance with various aspects as described herein.

As mentioned above, the present disclosure contemplates using one or more of the above-described container-based motion stabilizers. The use of multiple motion stabilizers provides for motion stabilization at multiple positions of a maritime structure in order adapt to different types of environmentally-induced motions (e.g., roll, pitch, etc.) acting on different parts of the structure. For example, FIG. 8 illustrates a floating structure 100 at water's surface 202 having a submerged container system coupled thereto that includes two of the above-described motion stabilizers positioned at and cooperating with opposing sides of floating structure 100. Each tension member 30 has its corresponding end 32 coupled to a peripheral portion of floating structure 100. Each tension member 30 passes through water surface 202 where its second end(s) 34 is ultimately coupled to a corresponding container 20 as described previously herein. In some embodiments, a winch and take-up reel (not shown) may be provided on the floating structure for each tension member 30.

Figure 9:
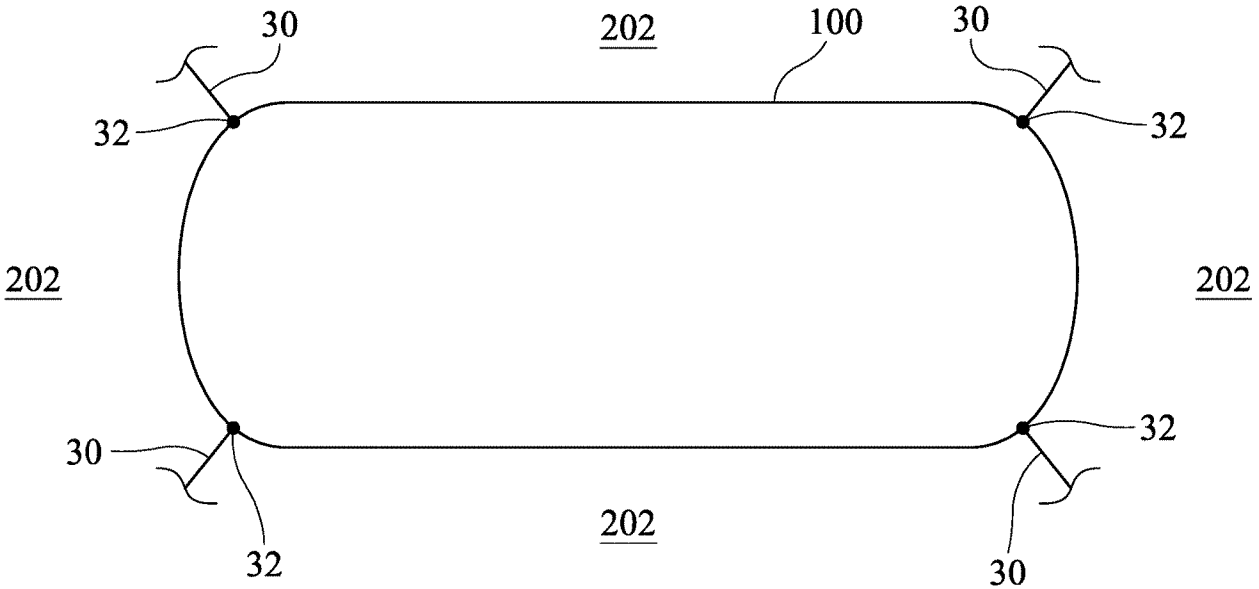
FIG. 9 illustrates a plan view of a rectangular maritime structure having a set of stabilizers of a submerged container system coupled to and distributed about the periphery of the structure in accordance with various aspects as described herein.
Figure 10:
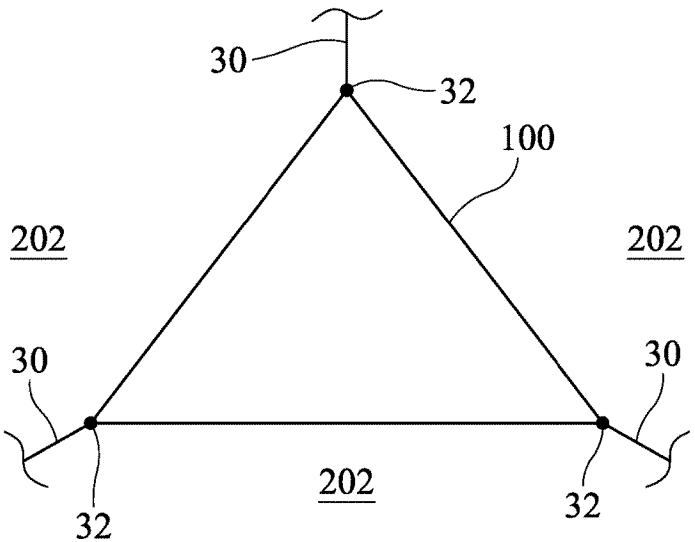
FIG. 10 illustrates a plan view of a triangular maritime structure having a set of stabilizers of a submerged container system coupled to and distributed about the periphery of the structure in accordance with various aspects as described herein.

The presently disclosed submerged container system may be used with a variety of maritime structures regardless of their size, shape, or configuration. For example, a substantially rectangular floating structure 100 is illustrated in a plan view thereof as it floats on water surface 202 in FIG. 9. Each tension member 30 is coupled to a peripheral location (e.g., corners, sides, etc.) on floating structure 100 where such peripheral locations may be distributed about the floating structure. Each tension member 30 passes through water surface 202 and extends into the water where it is coupled to a corresponding container (not shown) as described previously herein. In FIG. 10, a triangular floating structure 100 is illustrated in a plan view thereof as it floats on water surface 202 with tension members 30 being coupled to peripheral locations on floating structure 100 in a distributed fashion.

Figure 11:
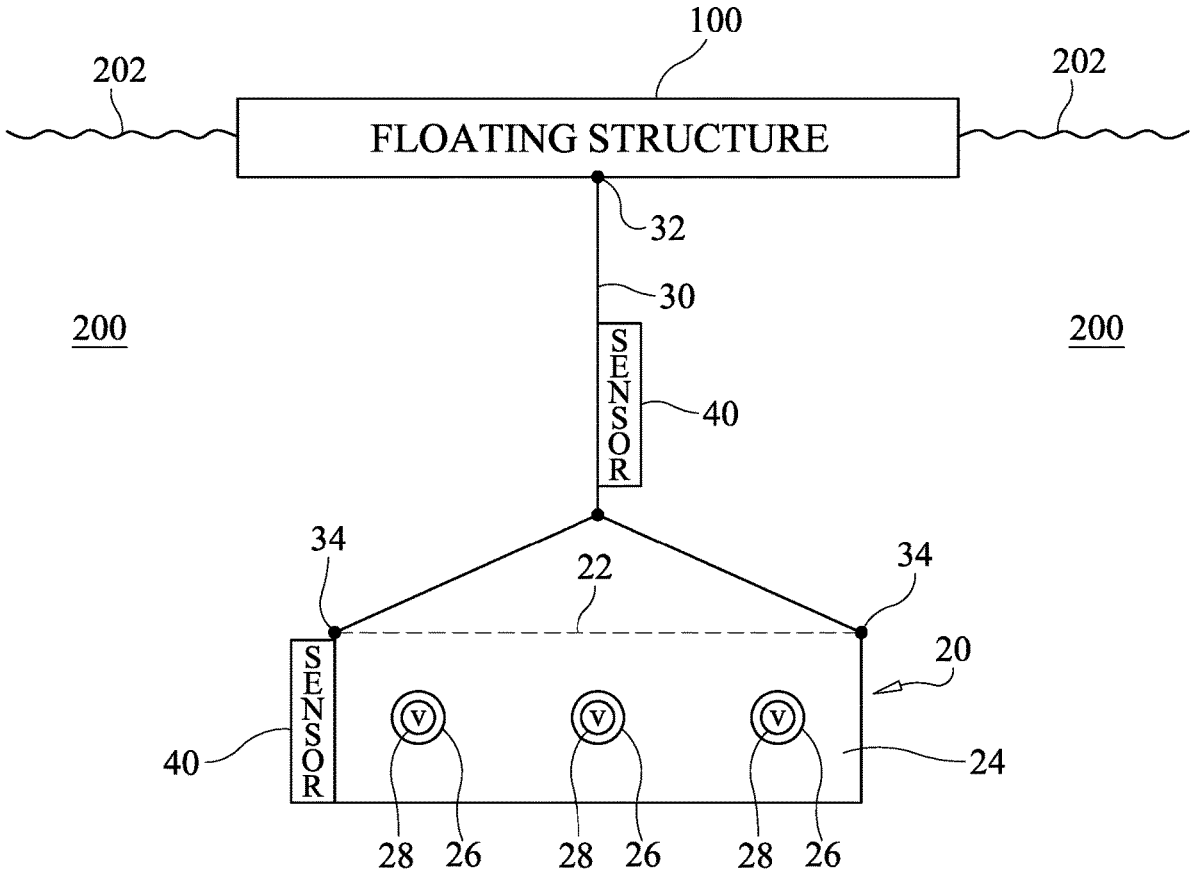
FIG. 11 illustrates a schematic view of another embodiment of a submerged container system for stabilizing environmentally-induced motion of a maritime structure in accordance with various aspects as described herein.

As described earlier herein, valves 28 may be configured to passively open/close to respectively unseal/seal their respective holes 26 based on movement of the floating structure relative to the tethered container(s). However, the submerged container system may also use actively controlled valves. For example and as illustrated in FIG. 11, a sensor 40 (or multiple sensors 40) may be coupled to container 20 and/or tension member 30. Sensors 40 are configured and operable to sense parameters indicative of floating structure 100 moving away from or towards container 20. The outputs of sensor(s) 40 may then be used to control the opening/closing of valves 28 as the means to unseal/seal the corresponding holes 26. In some embodiments, sensor(s) 40 may additionally or alternatively be used to control the hinges of a collapsible container to thereby control a container's collapsed or expanded state.

The advantages of the systems and methods described herein are numerous. The submerged container system provides a resistive and stabilizing force to the motion of a maritime structure. A large resistive force is created when the structure moves away from the system's submerged container(s). When the structure moves back towards the system's submerged container(s), the container(s) are configured to sink in the water in order to maintain a relatively constant force in a container's tension member that is much less than the previously created resistive force. Through this mechanism, the system's container(s) provide a 180° resistance to environmentally-induced heave, pitch, and roll experienced by the structure. Some configurations of the containers may be collapsible to facilitate transportation, storage, deployment, and retrieval. The systems and methods described herein do not require any contact or coupling to a sea floor and, therefore, are not encumbered with the complexities and costs associated with motion damping systems that rely on attachments to a sea floor.

Although the methods and systems presented herein have been described for specific embodiments thereof, there are numerous variations and modifications that will be readily apparent to those skilled in the art in light of the above teachings. For example, in some embodiments, one or more weights may be coupled to the "bottom" (i.e., in opposition to a container's open end) of a container to maintain a container's orientation (e.g., container's open end is perpendicular to its tension member) and/or to enhance a container's ability to sink through the water when its tethered structure undergoes the above-described downward motion 400 (FIG. 3). In some embodiments, a container's collapsible structure may be used as the sole mechanism to facilitate a container's ability to sink through the water when its tethered structure undergoes the above-described downward motion 400 (FIG. 3) thereby potentially obviating the need for the above-described holes/valves. It is therefore to be understood that, within the scope of the appended claims, the methods and systems presented herein may be practiced other than as specifically described.

What is claimed as new and desired to be secured by Letters Patent of the United States is:

1. A motion stabilizing system, comprising:

at least one stabilizer adapted to be coupled to a structure in a water environment, each said stabilizer including a tension member, an open-ended container having a set of holes, and at least one one-way valve associated with said holes wherein, for each said stabilizer, said tension member has a first end and a second end, said first end adapted to be coupled to a portion of the structure and said second end being disposed in the water environment, and said container being coupled to said tension member and suspended in the water environment; and said at least one one-way valve operable to seal said holes when the portion of the structure moves away from said container and operable to unseal said holes when the portion of the structure moves towards said container, wherein said container is configured to have an internal volume that increases when the portion of the structure moves away from said container and decreases when the portion of the structure moves towards said container.

2. The motion stabilizing system of claim 1, wherein said container is conically shaped.

3. The motion stabilizing system of claim 1, wherein said container comprises a collapsible container.

4. A motion stabilizing system, comprising:

at least one stabilizer adapted to be coupled to a structure in a water environment, each said stabilizer including a tension member, an open-ended container having a set of holes, and at least one one-way valve associated with said holes wherein, for each said stabilizer, said tension member has a first end and a second end, said first end adapted to be coupled to a portion of the structure and said second end being disposed in the water environment, and said container being coupled to said tension member and suspended in the water environment; and said at least one one-way valve operable to seal said holes when the portion of the structure moves away from said container and operable to unseal said holes when the portion of the structure moves towards said container, wherein each said one-way valve comprises a reed valve coupled to an inside surface of said container and configured to seal over at least one of said holes when the portion of the structure moves away from said container and move away from said at least one of said holes when the portion of the structure moves towards said container.

5. The motion stabilizing system of claim 4, wherein said container comprises a fixed-volume container.

6. A motion stabilizing system, comprising:

at least one stabilizer adapted to be coupled to a structure in a water environment, each said stabilizer including a tension member, a sensor coupled to said tension member, an open-ended container having a set of holes, and at least one one-way valve associated with said holes wherein, for each said stabilizer, said tension member has a first end and a second end, said first end adapted to be coupled to a portion of the structure and said second end being disposed in the water environment, and said container being coupled to said tension member and suspended in the water environment;

said at least one one-way valve operable to seal said holes when the portion of the structure moves away from said container and operable to unseal said holes when the portion of the structure moves towards said container; and said sensor operable to generate a first output when the portion of the structure is moving away from said container and generate a second output when the portion of the structure is moving towards said container, wherein each said one-way valve is configured to seal at least one of said holes when said first output is generated and unseal said at least one of said holes when said second output is generated.

7. A motion stabilizing system, comprising:

at least one stabilizer adapted to be coupled to a structure in a water environment, each said stabilizer including a tension member, a container having an open end and a set of holes in walls of said container, and at least one one-way valve associated with said holes wherein, for each said stabilizer, said tension member has a first end and a second end, said first end adapted to be coupled to a portion of the structure and said second end being disposed in the water environment, and said container being coupled to said tension member for suspension in the water environment with said open end facing towards a surface of the water environment; and said at least one one-way valve operable to seal said holes when the portion of the structure moves away from said container and operable to unseal said holes when the portion of the structure moves towards said container, wherein said container is configured to have an internal volume that increases when the portion of the structure moves away from said container and decreases when the portion of the structure moves towards said container.

8. The motion stabilizing system of claim 7, wherein said container is conically shaped.

9. The motion stabilizing system of claim 7, wherein said container comprises a collapsible container.

10. The motion stabilizing system of claim 7, wherein each said one-way valve comprises a reed valve coupled to an inside surface of said container and configured to seal over at least one of said holes when the portion of the structure moves away from said container and move away from said at least one of said holes when the portion of the structure moves towards said container.

11. The motion stabilizing system of claim 7, further comprising a sensor coupled to said tension element, said sensor operable to generate a first output when the portion of the structure is moving away from said container and generate a second output when the portion of the structure is moving towards said container, wherein each said one-way valve is configured to seal at least one of said holes when said first output is generated and unseal said at least one of said holes when said second output is generated.

12. A motion stabilizing system, comprising:

a set of stabilizers adapted to be distributed about a periphery of a structure in a water environment, each of said stabilizers including a tension member, an open-ended container having a set of holes, and at least one one-way valve associated with said holes wherein, for each of said stabilizers, said tension member has a first end and a second end, said first end adapted to be coupled to a peripheral portion of the structure and said second end being disposed in the water environment, and said container being coupled to said tension member and suspended in the water environment; and said at least one one-way valve operable to seal said holes when the peripheral portion of the structure moves away from said container and operable to unseal said holes when the peripheral portion of the structure moves towards said container, wherein said container is configured to have an internal volume that increases when the peripheral portion of the structure moves away from said container and decreases when the peripheral portion of the structure moves towards said container.

13. The motion stabilizing system of claim 12, wherein said container is conically shaped.

14. The motion stabilizing system of claim 12, wherein said container comprises a collapsible container.

15. The motion stabilizing system of claim 12, wherein each said one-way valve comprises a reed valve coupled to an inside surface of said container and configured to seal over at least one of said holes when the peripheral portion of the structure moves away from said container and move away from said at least one of said holes when the peripheral portion of the structure moves towards said container.

16. The motion stabilizing system of claim 12, further comprising a sensor coupled to said tension element, said sensor operable to generate a first output when the peripheral portion of the structure is moving away from said container and generate a second output when the peripheral portion of the structure is moving towards said container, wherein each said one-way valve is configured to seal said at least one of said holes when said first output is generated and unseal said at least one of said holes when said second output is generated.

17. The motion stabilizing system of claim 6, wherein said container comprises a fixed-volume container.

* * * * *